United States Patent [19]

Yamaba et al.

[11] Patent Number: 4,988,393

[45] Date of Patent: Jan. 29, 1991

[54] METHOD FOR PRODUCING HIGH-STRENGTH STEEL HAVING IMPROVED WELDABILITY

[75] Inventors: Ryota Yamaba; Yukio Tsuda; Atsuo Tanaka; Keiichi Hattori, all of Tokai, Japan

[73] Assignee: Nippon Steel Corporation, Tokyo, Japan

[21] Appl. No.: 453,141

[22] Filed: Dec. 12, 1989

Related U.S. Application Data

[63] Continuation of Ser. No. 214,849, Jun. 30, 1988, abandoned, which is a continuation of Ser. No. 14,159, Feb. 12, 1987, abandoned, which is a continuation of Ser. No. 745,886, Jun. 18, 1985, abandoned.

[30] Foreign Application Priority Data

Jun. 19, 1984 [JP] Japan ..... 59-124442
Jun. 19, 1987 [JP] Japan ..... 59-124443

[51] Int. Cl.[5] ..... C21D 8/00
[52] U.S. Cl. ..... 148/12.4; 148/12 F
[58] Field of Search ..... 148/12 F, 12.1, 12.3, 148/12.4, 320, 328

[56] References Cited

FOREIGN PATENT DOCUMENTS

| | | | |
|---|---|---|---|
| 41-2763 | 2/1966 | Japan . | |
| 57-18865 | 11/1982 | Japan | 148/12 F |
| 58-96817 | 6/1983 | Japan | 148/12 F |
| 59-100214 | 6/1984 | Japan | 148/12 F |
| 60-21326 | 2/1985 | Japan | 148/12 F |
| 1084231 | 9/1967 | United Kingdom . | |
| 2132225 | 7/1984 | United Kingdom | 148/12 F |

OTHER PUBLICATIONS

Tetsu to Hagane vol. 67 (1981)'81-S1330.
Tetsu to Hagane vol. 68 (1982)'82-S1443.
Seitetsu Kenkyu vol. 273 (1971) pp. 9904 to 9921.

*Primary Examiner*—Deborah Yee
*Attorney, Agent, or Firm*—Kenyon & Kenyon

[57] ABSTRACT

High-strength steel having a tensile strength of 80 kgf/mm$^2$ or more is produced by one-line quenching or on-line quenching and tempering. The steel has also excellent low-temperature toughness and excellent weldability, which makes high temperature preheating unnecessary prior to welding. The composition is: C=0.04% to 0.11%; Si≦1.0%; Mn=0.5% to 2.00%, Mo=0.10% to 1.0%, Nb=0.005% to 0.05% B=0.0009% to 0.0012% Al≦0.1%; and N≦0.0060%.

11 Claims, No Drawings

METHOD FOR PRODUCING HIGH-STRENGTH STEEL HAVING IMPROVED WELDABILITY

This application is a continuation of application Ser. No. 214,849, filed June 30, 1988, which is a continuation of 014,159 filed Feb. 12, 1987 which is a continuation of 745,886 filed June 18, 1985, now all abandoned.

BACKGROUND OF THE INVENTION

1. Field of the Invention

The present invention relates a method for producing high-strength steel, particularly a steel material for a welded structure, e.g., for a pressure vessel, bridge, or construction machine, in which both high strength and weldability are required. More particularly, the present invention relates to an inexpensive method for producing a high-strength steel having a tensile strength of 80 kgf/mm$^2$ or more, even 90 kgf/mm$^2$ or more.

2. Description of the Related Art

Heretofore, high-strength steels for welded structure use have been produced by heat-treating alloyed steels, i.e., by off-line quenching an tempering of alloyed steels. A large amount of various alloying elements are necessary for obtaining the high strength. This not only increases the production cost, but also necessitates a high preheating temperature prior to welding so as to prevent weld cracks.

Japanese Examined Patent Publication (Kokoku) No. 41-2763 discloses a precipitation-hardening method for strengthening steel. In this method, steel with copresent molydenum (Mo) and niobium (Nb) is ordinarily quenched and tempered off-line, so that the steel is strengthened by Mo-Nb precipitates. In addition, since the quenching temperature is approximately 900° C. and is too low to solid-dissolve Nb and Mo greatly into a matrix, addition to the steel of a large amount of Nb and Mo is required so as to attain satisfactory precipitation hardening. This results in not only increased costs, but also problems in weldability, especially weld cracks. In order to avoid weld cracks, the steel must be preheated at a high temperature. There is thus a strong demand among users for steel for not requiring high-temperature preheating.

It is well recognized in the art that, in order to produce high-strength steel having a tensile strength of 80 kgf/mm$^2$ or more and improved weldability, a few percent of nickel (Ni) and occasionally Mo, may be added to the steel and the steel quenched and tempered. One of the prior proposals is found in Seitetsu Kenkyu Vol. 273 (1971) pp 9904 to 9921. However, such prior proposals are disadvantageous in that the production cost is high and the weldability is impaired due to the high amount of alloying elements.

It is known from Tetsu to Hagane Vol. 67 (1981)'81-S1330 that the mechanical properties of an Nb-containing steel are enhanced by means of on-line accelerated cooling applied for producing line pipe materials. In this method, however, controlled rolling must be carried out prior or the accelerated cooling, and the stop temperature of accelerated cooling must be raised.

In addition, Tetsu to Hagane Vol. 68 (1982) '82-S1443 describes a direct quenching method followed by tempering, for producing high tensile steel. No consideration is found in this publication as to producing steel having a high tensile strength and improved weldability under the as-quenched state.

SUMMARY OF THE INVENTION

It is an object of the present invention to provide a method for producing high-strength steel having a high strength of 80 kgf/mm$^2$ or more, enhanced toughness, and improved weldability, especially resistance against the weld cracks, which characteristics are required for producing welded structures.

It is another object of the present invention to provide a method for producing, at a low cost, ultra high tensile strength steel having a tensile strength of 90 kgf/mm$^2$ or more in such a manner that improved, low-temperature toughness and weldability are imparted to the steel.

According to the present invention, high-strength steel having a tensile strength of 80 kgf/mm$^2$ or more is produced by heating, to a temperature of 1000° C. or higher, a steel which contains, as basic components, by weight percentage, from 0.04 to 0.11% of C, 1.0% or less of Si, from 0.50 to 2.00% of Mn, from 0.10 to 1.0% of Mo, from 0.005 to 0.05% of Nb, 0.0012% or less of B, 0.1% or less of Al, and 0.0060% or less of N; rolling the heated steel at a finishing temperature of rolling of 800° C. or more; directly, after the rolling, rapidly cooling to a temperature of 200° C. or less; and then tempering to a temperature of $AC_1$ or less. This method is hereinafter referred to as the "on-line Q-T method."

A high-strength steel having a tensile strength of 90 kgf/mm$^2$ or more is produced by heating, to a temperature of 1000° C. or higher, a steel which contains, as basic components, by weight percentage, from 0.04 to 0.11% of C, 1.0% or less of Si, from 0.50 to 2.00% of Mn, from 0.10 to 1.0% of Mo, from 0.005 to 0.05% of Nb, 0.0012% or less of B, 0.1% or less of Al, and 0.0060% or less of N; and rapidly cooling, after the completion of rolling, from a temperature of 800° C. or more to a temperature of 200° C. or less. This method is hereinafter referred to as the "On-line Q method." The steel has also excellent low-temperature toughness and excellent weldability, which makes high temperature preheating unnecessary prior to welding.

DESCRIPTION OF THE PREFERRED EMBODIMENTS

The present inventors made various experiments and considerations and discovered that when a steel composition containing Nb - Mo - boron (B) - small nitrogen (N) in an appropriate amount is on-line quenched and is then, occasionally tempered, the objects of present invention are attained.

The steel mentioned above may further contain at least one element selected from the group consisting of 1% or less of chromium (Cr), 1% or less of Ni, 1% or less of copper (Cu), 0.1% or less of vanadium (V), and 0.01% or less of calcium (Ca), the balance being essentially iron (Fe) and unavoidable impurities. Preferably, the Ni content is minor, if any Ni is contained.

The above-mentioned two methods are first explained with more metallurgical terms.

The steel containing Nb-Mo-B-N is on-line quenched or on-line quenched and tempered. Nb and Mo are solid-dissolved in the heating step prior to the on-line quenching.

In the two methods, the improving effects of hardenability by B and Mo are exceeding enchance. More specifically, a small amount of Nb eliminates detrimental effects of N upon the improving effect of hardenability by B and greatly enhanced it. Since the N content is set extremely low, a small amount of Nb can attain such enhancement. Nb and Mo, having also an improving effect of hardenability, enhance hardenability higher than Nb or Mo alone. The hardenability enhancement effect by Nb and Mo is also combined with that of B, so that the steel, which has only a small amount of alloying elements, is exceedingly strengthened. Notwithstanding the high strength, the weldability is improved because of the small amount of alloying elements. In addition, the low-temperature toughness if improved particularly in the on-line Q-T method, since the microscopic structure of tempered steel is principally acicular ferrite and bainite.

In the on-line Q-T method, and solute Nb and Mo generate Mo-Nb precipitates and cause outstanding precipitation hardening. The solute Nb and Mo, which are dissolved during the on-line heating, precipitate as Mo-Nb precipitates duing subsequent tempering. The precipitation hardening, occurring due to Mo-Nb precipitates, is exceeding great and is unexpected from the fact that the steel has a low Nb content.

The on-line Q-T method makes it possible to produce steel having a tensile strength of 80 kgf/mm$^2$ or more. Weldability and low-temperature toughness are improved, notwithstanding the small amount of alloying elements. The tensile strength of steel produced by the "on-line Q method" can be 90 kgf/mm$^2$ or more. It is to be noted that the on-line Q and on-line Q-T methods are appropriate for producing 50 mm or thicker steel sheet having the above-described tensile strength of 80 kgf/mm$^2$ or more and 90 kgf/mm$^2$ or more as well as improved weldability.

The composition of steel to be subjected to the on-line Q and on-line Q-T methods is now explained.

C in an amount of at least 0.04% is necessary for obtaining high strength. C in an amount exceeding 0.11% impairs the weldability of steel for the on-line Q method and impairs the low temperature toughness and resistance against weld cracks of steel for the on-line Q-T method.

Si is a deoxidizing and strengthening element of steel. However, Si in an amount exceeding 1.0% seriously impairs the low-temperature toughness. Si in an amount of 0.1% or more is effective for strengthening the steel. Therefore, Si is preferably contained in an amount of 0.1% or more.

Mn in an amount of 0.5% or more is necessary for providing high strength. However, Mn in an amount of 2.0% or more impairs the low-temperature toughness and weldability.

Mo strengthens steel and enhances the low-temperature toughness. Such strengthening and toughness enhancement by Mo are small at an Mo content of less than 0.1%. On the other hand, when the Mo content is more than 1%, strength is enchanced but the excellent low-temperature toughness is impaired and the cost is increased for both methods. A preferred Mo content is from 0.25% to 0.60%.

Nb improves the hardenability enhancement effect of B, by means of fixing N with Nb. In order to fix N with Nb, 0.005% or more of Nb is necessary. Nb precipitates together with Mo for attaining the precipitation hardening. The addition of Nb along with lowering the N content improves the hardenability enhancement effect of B. Such improvement is particularly significant in the case of the on-line Q method. This is attained by 0.005% or more of Nb.

When the Nb content exceeds 0.05%, the low-temperature toughness is impaired in the on-line Q method, the weldability is impaired in the on-line Q-T method, and the cost is increased in both methods.

B enhances the hardenability generally. In the present invention, the hardenability-enhancement effect of B is improved by the Mo and Nb addition and by reducing the N content as described above. B is effective for enhancing the hardenability at a minor content. B in an amount of 0.0012% or more impairs the weldability for the on-line Q-T method and impairs the low-temperature toughness for the on-line Q method.

Al is used for the deoxidation of steel but impairs the cleanness of steel at an amount exceeding 0.1%.

N is a usual unavoidable impurity and impairs the hardenability-enhancement effect of B added in steel. The highest N content is set at 0.006% so as to enhance the hardenability by a small amount of Nb. A preferred n content is 0.004% or less.

Cr is useful for enhancing the hardenability, but impairs the weldability at an amount exceeding 1.0%.

Ni is useful for enhancing the hardenability, but increases the cost at an amount exceeding 1.0%.

Cu is useful for enchancing the hardenability and strength of steel, but results in a tendency toward surface cracks of a steel sheet at an amount exceeding 1%. In addition, the cost is increased at a Cu content exceeding 1%.

Vanadium strengthens steel, but impairs the weldability at an amount exceeding 0.1%.

Ca is added to refine steel so as to improve the deoxidation of steel, to decrease the amount of inclusions, and to control and morphology of sulfideinclusions, thereby effectively enhancing the low-temperature toughness. Ca remaining in the steel in a large amount, however, tends to form detrimental non-metallic inclusions and to impair the low-temperature toughness. The Ca content is, therefore, 0.01% or less.

The amounts of phosphorus (P) and sulfur (S), which are unavoidably contained impurities of steel, are not specified but should be as low as possible. The preferred highest contents of P and S are 0.020% and 0.010%, respectively, so as to enhance the cleanness and hence stabilize the material properties of steel.

The heating, rolling and heat-treating in the on-line Q-T method and on-line Q method are now explained.

The heating is carried out at a temperature of 1000° C. or more. At this heating temperature, Nb is solid-dissolved.

The hot-rolling is finished at a temperature of 800° C. or more, since if the finishing temperature of hot-rolling is too low, the hardenability of steel is lessened and hence the subsequent tempering cannot provide a satisfactory low-temperature toughness. After the hot-rolling, preferably directly after the hot-rolling, rapid cooling is carried out. "Rapid cooling" herein is cooling at a rate of 6° C./second or more and can be carried out by supplying a cooling medium, such as water or mist, on to the front and rear surfaces of a steel sheet. The starting temperature of rapid cooling is 800° C. or more, because the hardenability is lessened if the rapid cooling is started at a low temperature. The rapid cooling is competed at a temperature of 200° C. or less, because a completely quenched structure is difficult to form if the completion temperature of rapid cooling is high.

Subsequent to the above treatment, tempering is carried out in the on-line Q-T method. The tempering is carried out at the ferrite region to obtain an improved low temperature toughness. The highest tempering temperature is therefore $Ac_1$.

The present invention is now explained by way of examples.

EXAMPLE 1

Steels having the compositions as given in Table 1 were subjected to heating, rolling, and heat-treating as given in Table 2. In Table 2, the mechanical properties and the resistance against weld cracks of the produced steel sheets ar also given.

In summary, Tables 1 and 2 clarify the following: The alloying elements according to the present invention feature inclusion of Nb, Mo, and B and reduced N content. The solute Nb and Mo, which are solid-dissolved during heating, are effectively precipitated during tempering, and the precipitation is utilized to the maximum extent for strengthening steel. Contrary to this, N in a large amount impedes the effective precipitation (steel G), and precipitation in which Nb principally participants does not cause an outstanding hardening (steel F).

Mo and Nb contributed to improving the hardenability-enhancement effect of B in all steels. Nevertheless, in steel G, the strength and low-temperature toughness were not excellent because of the high N content. Contrary to this, the reduction in the N content according to the present invention enhances the above-mentioned contribution of Mo and Nb and hence hardenability of steels A to E. This in turn provides an advantage that steels A to D are free of Ni, which is frequently used for conventional 80 kfg/mm² steels. Steel E has the highest tensile strength, and an improved toughness.

DQT, i.e., the process without off-line quenching, can provide a strength equal or superior to that of steel H processed by off-line quenching an tempering. Accordingly, a high-strength steel which even has an excellent low-temperature toughness can be produced at a low cost.

TABLE 1

| Examples | | Chemical Composition (wt %) C | Si | Mn | P | S | Mo | Nb | Al | B | N | Others |
|---|---|---|---|---|---|---|---|---|---|---|---|---|
| Invention | A | 0.09 | 0.26 | 1.45 | 0.015 | 0.006 | 0.36 | 0.026 | 0.056 | 0.0011 | 0.0038 | — |
| | B | 0.06 | 0.26 | 1.62 | 0.016 | 0.005 | 0.43 | 0.019 | 0.060 | 0.0010 | 0.0050 | — |
| | C | 0.07 | 0.25 | 1.39 | 0.016 | 0.004 | 0.60 | 0.018 | 0.058 | 0.0010 | 0.0036 | Cu 0.3 |
| | D | 0.07 | 0.25 | 1.44 | 0.017 | 0.006 | 0.38 | 0.017 | 0.055 | 0.0009 | 0.0044 | Cu 0.3 V 0.03 |
| | E | 0.06 | 0.26 | 1.42 | 0.015 | 0.005 | 0.39 | 0.022 | 0.56 | 0.0010 | 0.0035 | Cr 0.3 V 0.03 Ca 0.0036 Ni 0.2 |
| Comparative | F | 0.08 | 0.26 | 1.48 | 0.017 | 0.006 | 0.38 | 0.017 | 0.036 | — | 0.0050 | — |
| | G | 0.07 | 0.27 | 1.45 | 0.015 | 0.004 | 0.42 | 0.015 | 0.061 | 0.0011 | 0.0070 | — |
| | H | 0.13 | 0.25 | 1.38 | 0.013 | 0.004 | 0.52 | 0.022 | 0.055 | 0.0012 | 0.0036 | — |

TABLE 2

| | | Production Conditions as well as Mechanical Properties and Weld Cracks | | | | | | | | | | |
|---|---|---|---|---|---|---|---|---|---|---|---|---|
| | | Heating Temperature (°C.) | Finishing Temperature of Rolling (°C.) | Stop Temperature of Rapid Cooling (°C.) | Off-line Quenching Temperature (°C.) | Tempering Temperature (°C.) | Mechanical Properties Y.S. (kgf/mm²) | T.S. (kgf/mm²) | vTrs (°C.) | Stop Temperature of Y-Crack (°C.) | Heat Treatment Type | Sheet Thickness (mm) |
| Invention | A | 1100 | 830 | 98 | — | 640 | 78.8 | 83.6 | −91 | 25 | DQT | 25 |
| | B | " | 854 | 112 | — | " | 79.7 | 84.8 | −82 | " | " | " |
| | C | " | 867 | 120 | — | " | 81.1 | 85.2 | −87 | " | " | " |
| | D | " | 823 | 189 | — | " | 79.3 | 83.5 | −76 | " | " | " |
| | E | " | 853 | 106 | — | " | 85.0 | 89.9 | −52 | " | " | 55 |
| Comparative | F | " | 847 | 96 | — | " | 68.5 | 78.7 | −3 | " | " | 25 |
| | G | " | 836 | 102 | — | " | 68.3 | 79.4 | −13 | " | " | " |
| | H | 1250 | 955 | — | 910 | " | 80.5 | 85.6 | −41 | 125 | QT | " |

Note 1: Starting temperature of rapid cooling does not greatly differ from the finishing temperature of rolling.
Note 2: DQT: Direct quenching-temperature, QT: Off-line quenching-temperature As is apparent from Tables 1 and 2, in the steels A–E according to the present invention, a high tensile strength exceeding 80 kgf/mm² is obtained. Further an excellent low-temperature toughness in terms of vTrs (ductile brittle transition temperature of V-notch Charpy value) is obtained for 25 mm thick steel sheet having vTrs < −60° C. and 55 mm thick steel sheet having vTrs < −50° C. The stop temperature of Y-cracks, indicative of the resistance against weld cracks, is room temperature, which indicates a high resistance against the weld cracks and hence thus steel plates easily used by welders.

Steel F (comparative example), which is free of B and is subjected to DQT treatment, has a tensile strength slightly less then 80 kgf/mm² and a poor low-temperature toughness.

Steel G (comparative example), which contains a large amount of N, has a low tensile strength and a poor low-temperature toughness.

Steel H (comparative example), which has a high C content and is subjected to conventional off-line quenching an tempering, has excellent strength and toughness but poor resistance against weld cracks since the stop temperature of Y-cracks is 125° C.

EXAMPLE 2

Steels having the compositions as given in Table 3 were subjected to heating, and rolling as given in Table 4. In Table 3, the mechanical properties and the resistance against weld cracks of the produced steel sheets are also given.

TABLE 3

| Examples | | Chemical Composition (wt %) C | Si | Mn | P | S | Mo | Nb | Al | B | N | Others |
|---|---|---|---|---|---|---|---|---|---|---|---|---|
| Invention | I | 0.08 | 0.25 | 1.45 | 0.012 | 0.003 | 0.38 | 0.030 | 0.061 | 0.0010 | 0.0049 | — |
| | J | 0.06 | 0.23 | 1.38 | 0.015 | 0.004 | 0.43 | 0.015 | 0.055 | 0.0010 | 0.0031 | — |
| | K | 0.07 | 0.26 | 1.64 | 0.015 | 0.005 | 0.41 | 0.18 | 0.058 | 0.0009 | 0.0041 | Cu 0.3 Ni 0.1 |
| | L | 0.07 | 0.23 | 1.40 | 0.017 | 0.006 | 0.35 | 0.022 | 0.056 | 0.0012 | 0.0052 | Cu 0.3 V 0.02 |
| | M | 0.07 | 0.25 | 1.37 | 0.013 | 0.004 | 0.39 | 0.017 | 0.051 | 0.0011 | 0.0036 | Cr 0.3 V 0.03 Ca 0.0036 |
| Comparative | N | 0.07 | 0.26 | 1.42 | 0.021 | 0.004 | 0.45 | — | 0.056 | 0.0009 | 0.0044 | — |
| | O | 0.08 | 0.25 | 1.40 | 0.015 | 0.003 | 0.40 | 0.015 | 0.056 | 0.0011 | 0.0068 | — |
| | P | 0.13 | 0.26 | 1.33 | 0.013 | 0.002 | 0.50 | 0.022 | 0.030 | 0.0011 | 0.0050 | — |

TABLE 4

| Examples | | Production Conditions as well as Mechanical Properties and Weld Cracks: Sheet Thickness (mm) | Heating Temperature (°C.) | Starting Temperature of Rapid Cooling (°C.) | Stop Temperature of Rapid Cooling (°C.) | Mechanical Properties Y.S. (kgf/mm²) | T.S. (kgf/mm²) | vTrs (°C.) | Stop Temperature of Y-Crack (°C.) | Heat Treatment Type |
|---|---|---|---|---|---|---|---|---|---|---|
| Invention | I | 25 | 1100 | 802 | 120 | 92.0 | 104.3 | −43 | 25 | DQ |
| | J | " | " | 815 | 85 | 87.0 | 98.1 | −52 | " | " |
| | K | " | " | 820 | 103 | 96.4 | 109.1 | −35 | " | " |
| | L | " | " | 808 | 123 | 85.2 | 95.3 | −50 | " | " |
| | M | 55 | " | 830 | 82 | 94.8 | 100.3 | −38 | " | " |
| Comparative | N | 25 | " | 820 | 103 | 71.7 | 81.2 | +10 | " | " |
| | O | " | " | 815 | 115 | 77.1 | 87.3 | +33 | " | " |
| | P | " | " | 819 | 95 | 109.2 | 131.4 | +38 | 125 | " |

Note 1: Rapid cooling was carried out by supplying cooling water to front and rear surface of a steel sheet directly after the rolling.

As is apparent from Table 3 and 4, steels I–M according to the present invention have high strengths and good low-temperature toughnesses as well as an excellent resistances against weld cracks in terms of a stop temperature of Y-cracks, which is 25° C.

Steel N (comparative example), which is free of Nb, has a low tensile strength and a poor low-temperature toughness.

Steel O (comparative example), which contains a large amount of N, has low tensile strength and a poor low-temperature toughness.

Steel P (comparative example), which has a high C content, has excellent strength and toughness, but poor resistance against weld cracks since the stop temperature of Y-cracks is 125° C.

In summary, Tables 3 and 4 clarify the following: The alloying elements according to the present invention feature inclusion of Nb, Mo, and B and reduced N and C contents.

Mo and Nb contributed to improving hardenability-enhancement effect of B in all steels. Nevertheless, in Steel O, the strength and low-temperature toughness were not excellent because of the high N content. Contrary to this, the reduction in the N content according to the present invention enhances the above-mentioned contribution of Mo and Nb and hence hardenability of steels I to M. This in turn provides an advantage that steels I, J, L, M are free of Ni which is frequently used for conventional 80 kfg/mm² steels.

The above feature of composition makes it possible to obtain an excellent low-temperature toughness and an excellent weldability by the on-line quenching method, which drastically reduces the production cost as compared with the conventional off-line quenching and tempering method.

What is claimed is:

1. A method for producing steel having a tensile strength of at least 80 kfg/mm², comprising: heating to a temperature of 1000° C. or higher, steel which consists essentially of as basic components, by weight percentage, from 0.04–0.11% of C, from 0.01–1.0% of Si, from 0.50–2.00% of Mn, from 0.10–1.0% of Mo, from 0.005–0.05% of Nb, from 0.0009–0.0012% of B, from 0.051–0.1% of Al, and 0.0060% or less of N, the balance being essentially Fe and unavoidable impurities thereby solid dissolving the solute Nb and Mo; rolling the heated steel at a finishing temperature of rolling of 800° C. or more, directly after rolling, rapidly cooling to a temperature of 200° C. or less; and then tempering to a temperature of $AC_1$ or less thereby precipitating the solid-dissolved Nb and Mo and improving the hardenability and weldability of the steel.

2. A method according to claim 1, wherein the Mo content is from 0.25 to 0.60%.

3. A method according to claim 1, wherein the N content is 0.004% or less.

4. A method according to claim 1, 2, or 3, wherein the steel is in the form of a sheet and has a thickness of 50 mm or more.

5. A method for producing steel having a tensile strength of at least 80 kfg/mm², comprising: heating to a temperature of 1000° C. or higher a steel which consists essentially of as basic components, by weight percentage, from 0.04–0.11% of C, from 0.1–1.0% of Si, from 0.50–2.00% of Mn, from 0.10–1.0% of Mo, from 0.005–0.05% of Nb, from 0.0009–0.0012% of B, from 0.051–0.1% of Al, and 0.2% or less of Ni, and 0.0060% or less of N, the balance being essentially Fe and unavoidable impurities thereby solid dissolving the solute Nb and Mo; rolling the heated steel at a finishing temperature of rolling of 800° C. or more, directly after rolling, rapidly cooling to a temperature of 200° C. or less; and then tempering to a temperature of $AC_1$ or less thereby precipitating the solid-dissolved Nb and Mo and improving the hardenability and weldability of the steel.

6. A method for producing steel having a tensile strength of at least 80 kfg/mm², comprising: heating to a temperature of 1000° C. or higher a steel which consists essentially of as basic components, by weight percentage, from 0.04–0.11% of C, from 0.1–1.0% of Si, from 0.5–2.00% of Mn, from 0.10–1.0% of Mo, from 0.005–0.05% of Nb, from 0.0009–0.0012% of B, from 0.051–0.1% of Al, and 0.2% or less of Ni, and 0.0060% or less of N, the balance being essentially Fe and unavoidable impurities thereby solid dissolving the solute Nb and Mo; rolling the steel at a temperature of at least 800° C.; rapidly cooling, after the completion of rolling, from a temperature of 800° C. or more to a temperature of 200° C. or less; and tempering the steel thereby precipitating the solid-dissolved Nb and Mo and improving the hardenability and weldability of the steel.

7. A method according to claim 5 or 6, wherein the steel further contains at least one element selected from the group consisting of 1% or less of Cr, 1% or less of Cu, 0.1% or less of V, and 0.01% or less of Ca.

8. A method according to claim 5 or 6, wherein the steel contains no Ni.

9. A method according to claim 5 or 6, wherein the Mo content is from 0.25 to 0.60%.

10. A method according to claim 5 or 6, wherein the N content is 0.004% or less.

11. A method according to claim 5 or 6, wherein the steel is in the form of a sheet and has a thickness of 50 mm or more.

* * * * *